United States Patent [19]

Takegawa

[11] Patent Number: 4,953,596

[45] Date of Patent: Sep. 4, 1990

[54] PICKING PERIOD SETTING DEVICE FOR A LOOM

[75] Inventor: Yujiro Takegawa, Ishikawa, Japan

[73] Assignee: Tsudakoma Kogyo Kabushiki Kaisha, Kanazawa, Japan

[21] Appl. No.: 405,974

[22] Filed: Sep. 12, 1989

[30] Foreign Application Priority Data

Sep. 16, 1988 [JP] Japan ..... 63-233197

[51] Int. Cl.[5] ..... D03D 47/36

[52] U.S. Cl. ..... 139/435.1; 139/435.2; 139/452; 139/55.1

[58] Field of Search ..... 139/1 R, 11, 116 R, 139/429, 435 R, 452, 55.1

[56] References Cited

U.S. PATENT DOCUMENTS 4,732,179 3/1988 Takegawa ..... 139/452 X
4,744,393 5/1988 Takegawa ..... 139/116 R
4,756,344 7/1988 Takegawa ..... 139/452
4,827,990 5/1989 Takegawa ..... 139/435
4,830,063 5/1989 Takegawa ..... 139/435

*Primary Examiner*—Andrew M. Falik
*Attorney, Agent, or Firm*—Oblon, Spivak, McClelland, Maier & Neustadt

[57] ABSTRACT

A picking period setting device for a loom to decide an appropriate picking period for satisfactory picking operations. A shedding curve calculating circuit is used which calculates shedding curves representing the shedding motion of heddle frames. A shedding stroke calculating circuit calculates a set of desired shedding stroke curves. An appropriate picking period deciding circuit decides a precise picking period defined by the crank angles of the loom on the basis of the result of comparison of the shedding curves and the desired shedding stroke curves. Thus, the weaving operation of the loom is continued without interruptions caused by faulty picking.

8 Claims, 6 Drawing Sheets

PICKING PERIOD SETTING DEVICE FOR A LOOM

RELATED ART

The present invention relates to a picking period setting device for a loom to set an appropriate picking period for satisfactory picking operation.

As is generally known, the jet loom weaves a fabric continuously by repeating a series of weaving processes of dividing warp yarns into an upper group of warp yarns and a lower group of warp yarns to form a shed by operating the heddle frames, inserting a weft yarn in the shed by a fluid jet, such as an air jet or a water jet, and driving the inserted weft yarn from the shed to the cloth fell by the reed.

The heddle frames are driven for shedding by a shedding mechanism, such as a tappet mechanism or a dobby mechanism. Generally, the heddle frames are operated in a negative shedding mode in which the heddle frames are moved positively only in one direction, i.e., either upward or downward, by a shedding mechanism and returned to the starting position by automatic return means, such as springs, except special cases including wool fabric weaving. In a negative shedding mode, the heddle frames connected to the shedding mechanism by wires are moved positively in one direction by a shedding mechanism, and then the same are returned to the starting position by extension springs each having one end fixed to the heddle frame and the other end fixed to the frame of the loom after the driving force of the shedding mechanism is removed from the wires. Such a shedding cycle is repeated periodically in synchronism with the operations of the other components of the loom, such as the picking mechanism and the reed. The heddle frames are driven selectively for shedding for each picking cycle to weave a fabric of a predetermined weave.

Generally, the recent high-speed jet loom carries out shedding operation and beating operation by a shedding mechanism and a beating mechanism which are interlocked mechanically with the main shaft of the jet loom, and carries out picking operation by detecting the crank angle of the main shaft thereof and by electrically actuating a picking controller at a predetermined crank angle of the main shaft. In determining the operating period of the picking controller, it has been necessary to determine an accurate angular period in which the weft yarn is able to run without interfering with the reed and the warp yarns (hereinafter referred to as "appropriate picking period") by visually observing the positional relation between the reed and the weft yarn in both forming a shed and closing the shed while the loom is operated by the operator.

Such a manner of determining an appropriate picking period requiring the manual operation and skill of the operator is very intricate. Furthermore, even if an appropriate picking period is determined in such a manner, the synchronism of the shedding motion and the picking motion can be deranged due to the variation of the period of picking cycle and/or the variation of the stroke of the heddle frames during the shedding motion owing to the elongation of the wires for driving the heddle frames and/or the abrasion of the component parts of the shedding mechanism and, consequently, the loom is liable to stop unavoidably due to faulty picking operation.

It is shown to detect the phase angle of the air jet loom and to detect the arrival of the free end of the picked weft yarn at an arrival position, and to control the picking conditions for adjusting the arrival phase angle variations, in U.S. Pat. No. 4,830,063.

Also it is shown to control the sequential air jetting operation of auxiliary nozzle groups, depending on a weft yarn release phase angle and an measured yarn arrival phase angle, in U.S. Pat. No. 4,827,990.

However what it is not shown is a manner of changing an appropriate picking period of weft yarn.

Thus, the conventional picking controller is not provided with any means for reflecting variations in the actual closing angle and stroke of the heddle frames on the picking control operation, and actuates the picking mechanism for picking operation simply at a fixed crank angle of the main shaft of the loom independently of the operation of the shedding mechanism. Accordingly, variations in the parameters of shedding motion resulting from variations in the mechanical conditions of the loom, such as the elongation of the wires for driving the heddle frames, affects the picking operation directly to cause faulty picks including bent picks and short picks. Particularly, the appropriate picking period for the jet loom is limited to a very narrow crank angle range to operate the jet loom at a very high weaving speed and hence the slight variation in the shedding parameters can directly result in faulty picking, such as a bent pick or short pick.

DISCLOSURE OF THE INVENTION

Accordingly, it is a first object of the present invention to provide a picking period setting device capable of automatically setting an accurate appropriate picking period without requiring the manual setting operation of the operator.

It is a second object of the present invention to provide a picking period setting device capable of regulating the picking operation of the loom according to variations in the shedding period and in the stroke of the heddle frames during the practical weaving operation of the loom.

Thus, the present invention provides a picking period setting device capable of simply and accurately setting an appropriate picking period, and capable of precisely setting an appropriate picking period according to variations in the shedding motion due to variations in the mechanical conditions of the loom, such as the elongation of the wire for driving the heddle frames, during the weaving operation of the loom so that the loom is able to continue the weaving operation without faulty picking.

Figure 1:
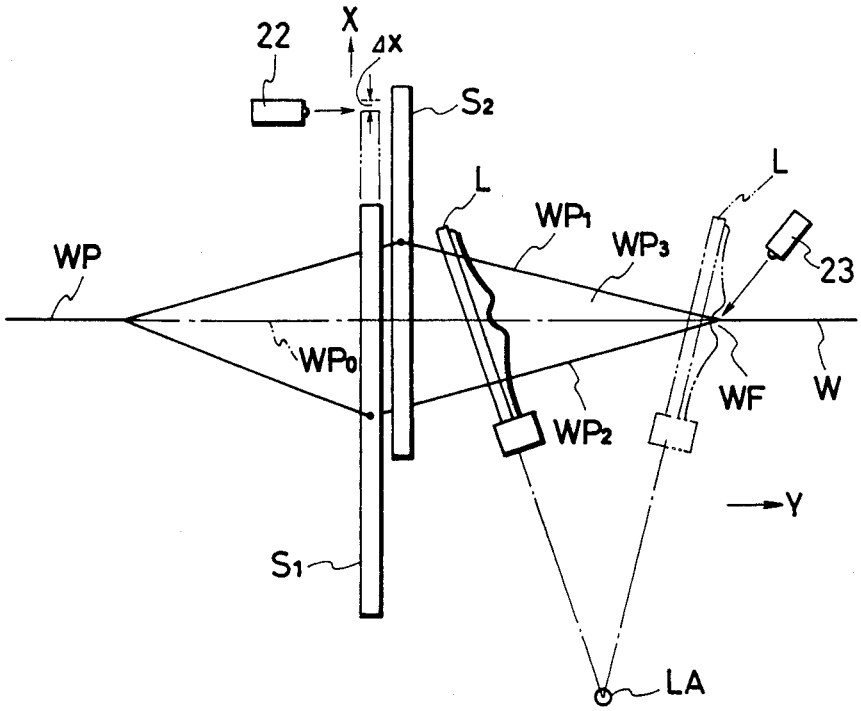
FIG. 1 is a diagrammatic illustration showing the constitution of an essential part of a loom incorporating a picking period setting device in a first embodiment according to the present invention.

In the drawings, H1 and H2 . . . shedding curves, Ho1, Ho2 . . . reference shedding curves, Xo1, Xo2 . . . desired shedding stroke curves, and St . . . loom stop signal.

DETAILED DESCRIPTION OF THE PREFERRED EMBODIMENTS

A picking period setting device in a typical embodiment according to the present invention will be described hereinafter with reference to FIGS. 1 to 6.

Shown in FIG. 1 is an air jet loom provided with a reed L, heddle frames S1 and S2 and a picking nozzle, not shown. Warp yarns WP are raised or depressed by the heddle frames S1 and S2 to form a shed WP3 by the upper warp yarns WP1 and the lower warp yarns WP2. The reed L beats a weft yarn, not shown, inserted in the shed WP3 to drive the weft yarn to the cloth fell WF so that the weft yarn is woven into a fabric W. The reed L reaches a position indicated by alternate long and two short dashes lines in FIG. 1 at the completion of the beating motion. The reed L rocks back and forth for beating motion about an axis LA of swing motion.

Figure 2:
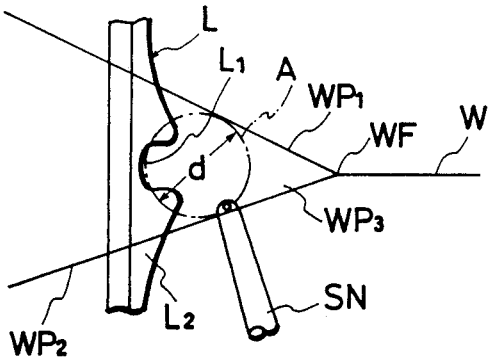
FIG. 2 is an enlarged diagrammatic illustration of an essential part of FIG. 1.

As shown in FIG. 2, the reed L comprises special dents L2 each having a guide recess L1 for guiding a picked weft yarn formed at a position where the dent L2 meets the cloth fell WF in beating the inserted weft yarn. Suppose that a weft yarn passing range A is defined by a circle with diameter d substantially entirely including the guide recess L1. Then, the weft yarn passing range A is the least range to be secured free of the upper warp yarns WP1 and the lower warp yarns WP2 so that the picked weft yarn can be inserted without obstruction. The air jet loom is provided with a plurality of auxiliary nozzles SN (only one of them is shown in FIG. 2) arranged widthwise of the loom under the lower warp yarns WP2. The extremities of the auxiliary nozzles SN each provided with a spouting hole are located above the lower warp yarns WP2.

A heddle frame sensor 22 (FIG. 1) is associated with the heddle frame S1 farther from the cloth fell WF to measure the deviation $\Delta X$ along the X-axis of the upper standby position of the heddle frame S1 from a reference position. The deviation $\Delta x$ corresponds, for example, to the elongation of wires for driving the heddle frame S1. A cloth fell sensor 23 is disposed near the cloth fell WF to detect the position $(z_1, y_1)$ of the cloth fell WF indicated by coordinates of a coordinate system defined by the X-axis and the Y-axis as indicated by arrows X and Y in FIG. 1.

Figure 3:
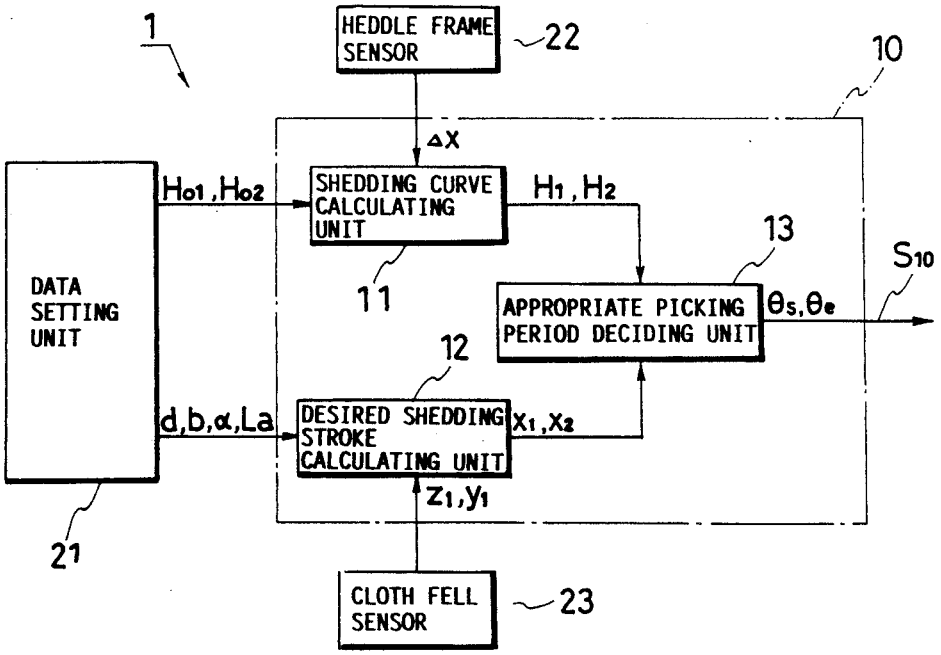
FIG. 3 is a block diagram of the picking period setting device of FIG. 1.

Referring to FIG. 3, a picking period setting device 1 in a first embodiment according to the present invention comprises a control unit 10, a data setting unit 21, the heddle frame sensor 22 and the cloth fell sensor 23. The control unit 10 includes a shedding stroke curve calculating unit 11, a desired shedding stroke calculating unit 12 and an appropriate picking period deciding unit 13.

Set data is stored in the data setting unit 21 for use by the control unit 10. The outputs of the data setting unit 21 is connected to the respective inputs of the shedding stroke curve calculating unit 11 and desired shedding stroke calculating unit 12 of the control unit 10. The respective outputs of the heddle frame sensor 22 and the cloth fell sensor 23 are connected respectively to the input of the shedding stroke curve calculating unit 11 and the input of the desired shedding stroke calculating unit 12.

The respective outputs of the shedding stroke curve calculating unit 11 and the desired shedding stroke calculating unit 12 are connected to the inputs of the appropriate picking period deciding unit 13. The appropriate picking period deciding unit 13 gives a reference picking signal S1O through the output thereof to an external device.

In operation, the data setting unit 21 gives data representing reference shedding curves Ho1 and Ho2 for the heddle frames S1 and S2 associated respectively with the upper warp yarns WP1 and the lower warp yarns WP2 (FIG. 4) to the shedding stroke curve calculating unit 11. The reference shedding curves Ho1 and Ho2 are reference curves representing the variations of the displacements of the heddle frames S1 and S2, respectively, with the crank angle $\theta$ of the loom. The data representing the reference shedding curves Ho1 and Ho2 is stored beforehand in the data setting unit 21.

The shedding stroke curve calculating unit 11 translates the reference shedding curve Ho1 and Ho2 by the deviation $\Delta x$ of the heddle frame S1 from the reference position of the same detected by the heddle frame sensor 22 to provide the respective actual shedding stroke curves H1 and H2 of the heddle frames S1 and S2.

The data setting unit 21 gives data representing the radius La of swing motion of the reed L, the distance b of the axis LA of swing motion of the reed L measured on the Y-axis of a rectilinear coordinate system defined by the X-axis included in a plane in which the heddle frame S1 moves and the Y-axis, the inclination $\alpha$ of the reed L at the end of the beating motion, and the diameter d of the weft yarn passing range A (FIG. 5) to the desired shedding stroke calculating unit 12. The values of the data are fixed values determined from fixed values representing the size and disposition of the mechanical parts of the loom and these values are stored beforehand in the data setting unit 21.

The radius La of the reed L, namely, the effective length of the reed L, is defined by the distance between the axis LA and the cloth fell WF. The position of the axis LA is defined by the distance b measured from the origin of the rectilinear coordinate system on the Y-axis. The inclination $\alpha$ is defined by an angle formed between the Y-axis and the reed L at the end of beating motion.

The desired shedding stroke calculating unit 12 estimates two straight lines a1 and a2 tangent to the circle representing the weft yarn passing range A and passing a position $(z_1, y_1)$ corresponding to the cloth fell WF by using the data given thereto from the data setting unit 21 and the data representing the position $(z_1, y_1)$ given thereto from the cloth fell sensor 23. The center Ao of the weft yarn passing range A is indicated by coordinates $(x_0, y_0)$ expressed by:

$$x_0 = La \sin(\alpha + \theta L)$$

$$y_0 = La \cos(\alpha + \theta L) + b$$

where $\theta L$ is the beating angle of the reed L, namely, an angle measured direction of the heddle frame S between the front beating up position and back position of the reed L. The circular weft passing range A is expressed by the equation expressing a circle with radius d/2 and with its center at the center Ao: ($x_0$, $y_0$).

The distances x1 and x2 between the intersection point ax0 of the X-axis and a reference warp line WPO, namely, a line along which all the warp yarns extend when the deviation $\Delta x=0$ and the shed is closed, and the respective X-intercepts ax1 and ax2 of the straight lines a1 and a2 are desired shedding strokes of the heddle frames S1 and S2 when the reed L is at the back position. That is, when the heddle frames S2 and S1 are moved for shedding so that the upper warp yarns WP1 extend above the straight line a1 and the lower warp yarns WP2 extend under the straight line a2, the upper warp yarns WP1 and the lower warp yarns WP2 do not interfere with the weft yarn traveling within the weft yarn passing range A.

Figure 4:
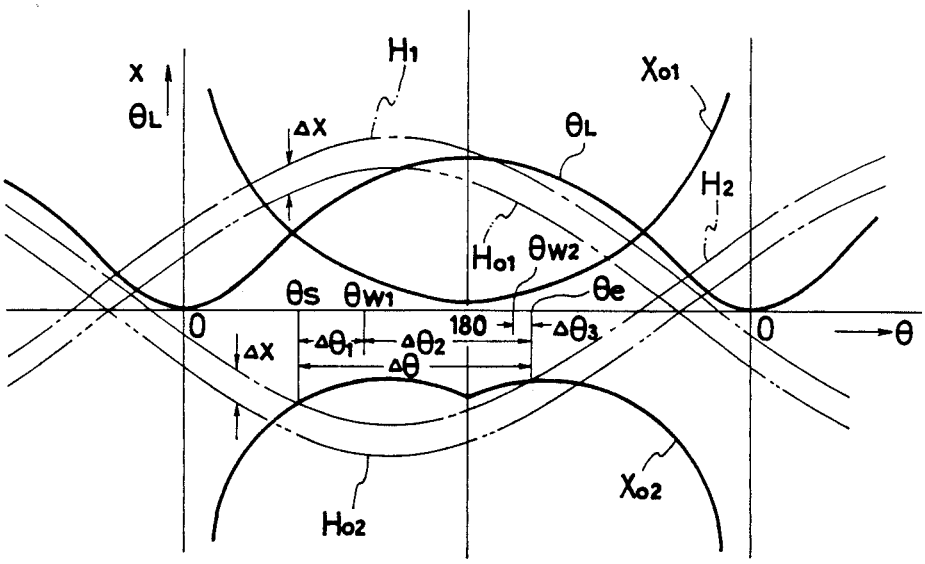
FIG. 4 is a diagram of assistance in explaining the operation of the picking period setting device of FIG. 1.

The distances x1 and x2 are dependent on the beating angle $\theta$L, and the beating angle $\theta$L is a function of the crank angle $\theta$ of the loom. Therefore, the desired shedding stroke curves Xo1 and Xo2 are expressed as functions of the crank angle $\theta$ as shown in FIG. 4 by expressing the beating angle $\theta$L by the crank angle $\theta$ and calculating the distances x1 and x2 for the crank angle $\theta$. The shapes of the desired shedding stroke curves Xo1 and Xo2 vary greatly depending on the position of the center Ao relative to the reference warp line WPo. Also shown in FIG. 4 is a curve $\theta$L representing the variation of the beating angle $\theta$L with the crank angle $\theta$ in one weaving cycle of the loom.

In FIG. 4, the beating angle $\theta_L$ corresponds to the crank angle $\theta$, the beating angle $\theta_L=0$ at $\theta=0$, and the beating angle $\theta_L$ is at its maximum at $\theta=180$. Accordingly the reed L swings between the front beating position WF ($\theta=0$) and the back position ($\theta=180$).

The actual shedding stroke curves $H_1$ and $H_2$ slide with the deviation $\Delta x$, from the reference shedding curves $H_{01}$ and $H_{02}$. The reference shedding curves $H_{01}$ and $H_{02}$ indicate the variations of the displacements of the heddle frames, corresponding to the crank angle $\theta$, the variations of displacements are symmetrized along the lateral axis, and the maximum of the displacement is found before $\theta=180$, and the curves $H_{01}$ and $H_{02}$ cross on the lateral axis before $\theta=0$ (when the heddle frames are closed completely). Since it is necessary that the picked weft yarn has been grasped between the upper and under warps before the time when the reed L is starting to move ($\theta=0$).

Figure 5:
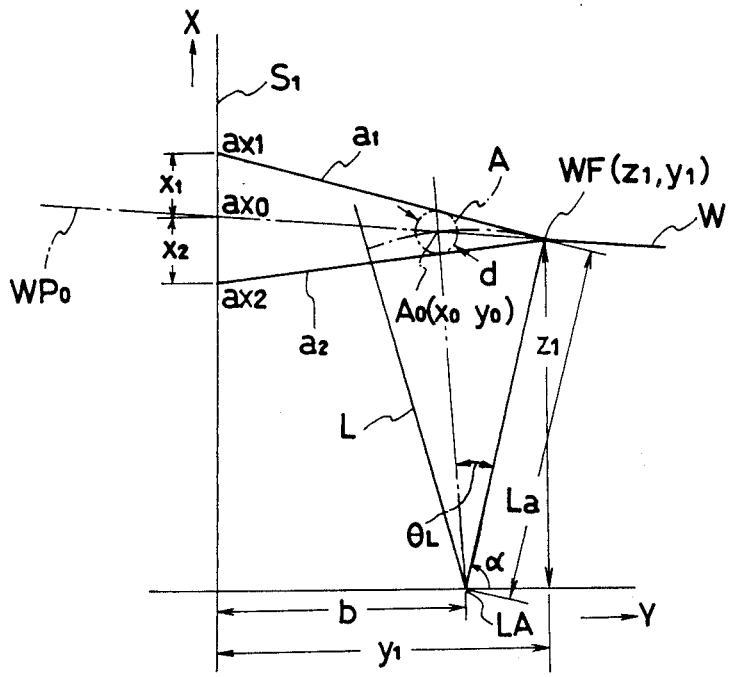
FIG. 5 is a diagram of assistance in explaining the motion of the reed of the loom.

The desired shedding stroke curves $X_{01}$ and $X_{02}$ correspond to the distances $x_1$ and $x_2$ for the crank angle $\theta$ (shown in FIG. 5). Also the distances $x_1$,$x_2$ are indicated by the X-intercepts $a_{x1}$ and $a_{x2}$ from the intersection point $a_{x0}$ of the X-axis (from the reference warp line WPo), as the straight lines $a_1$ and $a_2$ tangent to the circle representing the weft yarn passing range A and passing a position ($z_1$, $Y_1$).

Then at $\theta_L=0$ at $\theta=0$, the weft yarn passing range A is adjusted to the front beating position WF, the straight lines $a_1$ and $a_2$ do not indicate X-intercepts $a_{x1}$ and $a_{x2}$, as the result is expressed as $x_1=x_2=\infty$. $X_{01}=+\infty$ and $X_{02}=-\infty$.

When the reed L is positioned at the position separating from the front beating position WF and the crank angle $\theta_L$ is increased, the distance $x_1$ and $x_2$ are decreased, the desired shedding stroke curve $x_{01}$ shift downward from $+\infty$, and the desired shedding stroke curve $X_{02}$ shift upward from $-\infty$ in the condition $0<\theta<180$. When the weft yarn passing range A is shifted on the reference warp line WPo in a straight line, the desired shedding stroke curves $X_{01}$ and $X_{02}$ are symmetrical along the X-axis as shown in FIG. 4, but the actual weft yarn passing range A is shifted along the circle-part (the center is LA and the radius is La in FIG. 5; the circle-part is cross the reference warp line WPo), the desired shedding stroke curve $X_{01}$ is shifted in a smooth nmanner, and the desired shedding stroke curve $X_{02}$ is shifted along a convex curve line.

So it is indicated that the maximum value on the desired shedding stroke curve $X_{02}$, is at the distance when $x_2$ is at a minimum, and at this point that the weft yarn passing range A is reached to the peak position of X-axis in FIG. 5, namely the crank angle $\theta$is corresponded to $\theta_L+\alpha=90$ and $\theta_L=90-\alpha$.

When $\theta=180$, the reed L is positioned separating from the weft beating position WF at its extreme, the beating angle $\theta_L$ is at its maximum. When $180<\theta$, the weft yarn passing range A is shifted back along a locus as the same in $0<\theta<180$, the desired shedding stroke curves $X_{01}$, $X_{02}$ are symmetrical along the Y-axis as shown in FIG. 4.

Thus, the shedding stroke curve calculating unit 11 and the desired shedding stroke calculating unit 12 calculate the actual shedding stroke curves H1 and H2 and the desired shedding stroke curves Xo1 and Xo2 respectively. Then, the appropriate picking period deciding unit 13 decides an appropriate picking period $\Delta\theta$ between a crank angle $\theta$s ($\theta$s=an appropriate picking start crank angle, $\theta$e=an appropriate picking end crank angle) on the basis of the results of comparison of the actual shedding stroke curves H1 and H2 and the desired shedding stroke curves Xo1 and Xo2. The appropriate picking start crank angle $\theta$s ($0\leqq\theta\leqq180°$) is a crank angle where the value of the actual shedding stroke curve H1 for the upper warp yarns WP1 is greater than that of the desired shedding stroke curve Xo1, and the value of the actual shedding stroke curve H2 for the lower warp yarns WP2 is smaller than that of the desired shedding stroke curve Xo2. The appropriate picking end angle $\theta$e ($180°\leqq\theta e\leqq360°$) is a crank angle that does not meet the above conditions.

Figure 6:
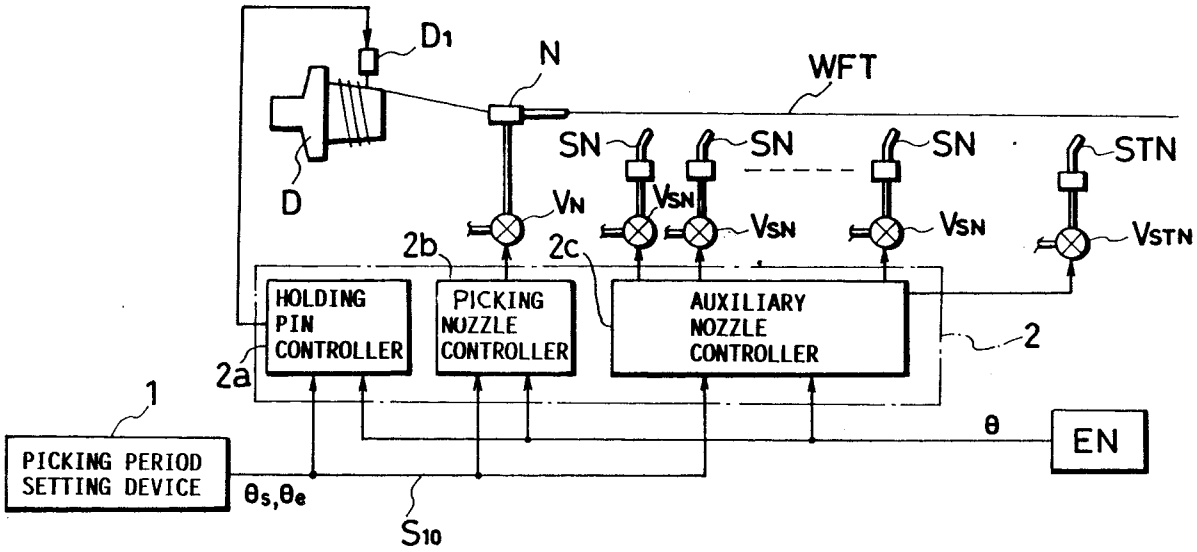
FIG. 6 is a diagrammatic illustration of a picking mechanism incorporating the picking period setting device of FIG. 1.

Then, as shown in FIG. 6, the picking period setting device 1 gives a reference picking signal S1O representing the appropriate picking start crank angle $\theta$s and the appropriate picking end crank angle $\theta$e thus decided by the appropriate picking period deciding unit 13 to a picking control unit 2, and then the picking control unit 2 controls the picking mechanism on the basis of the reference picking signal S1O.

As shown in FIG. 6, the picking control unit 2 comprises a holding pin controller 2*a*, a picking nozzle controller 2*b* and an auxiliary nozzle controller 2*c*. The holding pin controller 2*a* controls the holding pin D1 of a weft yarn measuring and storing device D, the picking nozzle controller 2*b* controls a picking nozzle N, and the auxiliary nozzle controller 2*c* controls a plurality of auxiliary nozzles SN and a stretching nozzle STN. The output of an encoder EN for detecting the crank angle $\theta$ of the loom is applied to the controllers 2*a*, 2*b* and 2*c*.

A weft yarn WFT unwound from a supply package, not shown, is wound for storage around the storage drum D (as shown in FIG. 6), not shown, of the weft yarn measuring and storing device D. The holding pin controller 2*a* retracts the holding pin D1 from the drum so that the weft yarn WFT of a length for one picking cycle is released from the storage drum when the output of the encoder EN coincides with the appropriate picking start crank angle $\theta s$. The picking nozzle controller 2b and the auxiliary nozzle controller 2c control the picking nozzle N, the auxiliary nozzles SN and the stretching nozzle STN to spout air by the picking nozzle N, the auxiliary nozzles SN and the stretching nozzle STN in synchronism with the retraction of the holding pin D1. The picking nozzle N, the auxiliary nozzles SN and the stretching nozzle STN are connected through control valves VN, VSN and VSTN, respectively, to a compressed air source, not shown. The picking nozzle controller 2b and the auxiliary nozzle controller 2c control the control valves VN, VSN and VSTN so that the picking nozzle N, the auxiliary nozzles SN and the stretching nozzle STN jet air respectively at appropriate crank angles for appropriate periods.

The controllers 2a, 2b and 2c of the picking control unit 2 determine operation start crank angles and operation end crank angles respectively for the holding pin D1, the picking nozzle N, the auxiliary nozzles SN and the stretching nozzle STN, so that the weft yarn WFT is inserted under optimum conditions in an optimum picking period defined by the appropriate picking start crank angle $\theta$ and the appropriate picking end crank angle $\theta e$.

Naturally, the number of heddle frames need not be limited to two; the loom may be provided with an optional number of heddle frames. When the loom is provided with more than two heddle frames, the heddle frame operated in a mode represented by the desired shedding stroke curves Xo1 and Xo2 having the greatest amplitudes among the desired shedding stroke curves, namely, the heddle frame farthest from the cloth fell WF corresponds to the heddle frame S1.

This picking period setting device 1 is applicable also to water jet looms not provided with any auxiliary nozzles SN and stretching nozzle STN, shuttleless looms and shuttle looms. However, the shape of the weft yarn passing range A necessary for calculating the desired shedding stroke curves Xo1 and Xo2 need not necessarily be circular, the shape may be one of optional shapes including an ellipse depending on the type of the loom to which the picking period setting device is applied. For example, when the picking period setting device is applied to a water jet loom, the diffusion of a water jet jetted by the picking nozzle must be taken into consideration in determining the shape of the weft yarn passing range A. When the picking period setting device is applied to a rapier loom, a space for receiving the head of the rapier must be taken into consideration. Furthermore, the shape and size of the weft yarn passing range A may be determined by using experimental data obtained through trial weaving operation in addition to design parameters so that the loom is able to operate most satisfactorily.

Figure 7:
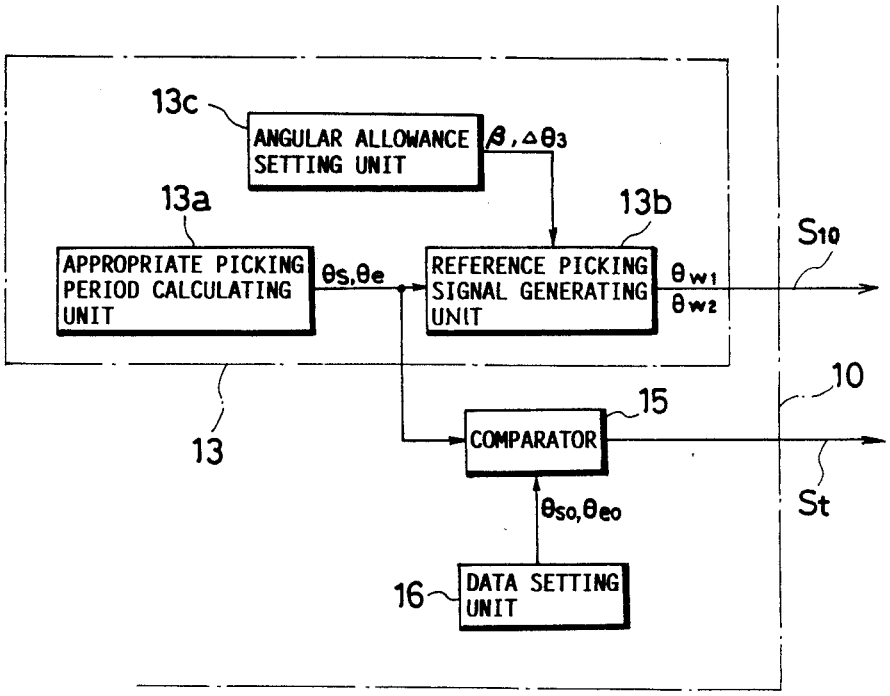
FIG. 7 is a block diagram of a picking period setting device in a second embodiment according to the present invention.

A picking period setting device in a second embodiment according to the present invention employs an appropriate picking period deciding unit 13 as shown in FIG. 7 instead of the foregoing appropriate picking period deciding unit 13. The appropriate picking period deciding unit 13 shown in FIG. 7 comprises an appropriate picking period calculating unit 13a which calculates the appropriate picking start crank angle $\theta s$ and the appropriate picking end crank angle $\theta e$ by the foregoing procedure, a reference picking signal generating unit 13b and an angular allowance setting unit 13c. The reference picking signal generating unit 13b receives the appropriate picking start crank angle $\theta s$ and the appropriate picking end crank angle $\theta e$ from the appropriate picking period calculating unit 13a, calculates a weft yarn release crank angle $\theta w1$ (FIG. 4) and a weft yarn check crank angle $\theta w2$ (FIG. 4), and gives a reference picking signal S1O representing the crank angles $\theta w1$ and $\theta 2$ to the picking control unit 2. The picking operation has an angular allowance as long as the weft yarn release crank angle $\theta w1$ and the weft yarn check crank angle $\theta w2$ thus determined are included in the appropriate picking period $\Delta\theta = \theta e - \theta s$ regardless of variation in shedding condition. Accordingly, the operation start crank angles and operation end crank angles of the components of the picking mechanism determined on the basis of the weft yarn release crank angle $\theta w1$ and the weft yarn check crank angle $\theta w2$ need not be calculated for each picking cycle. This control mode simplifies the picking control unit 2.

The weft yarn release crank angle $\theta w1$ may be determined by dividing the appropriate picking period $\Delta\theta$ by using an appropriate distribution ratio $\beta = \Delta\theta 1/\Delta\theta 2(\Delta\theta 1 + \Delta\theta 2 = \Delta\theta)$. The value of the distribution ratio $\beta$ is dependent on the type and size of the weft yarn WFT and is set by the angular allowance setting unit 13c. The weft yarn check crank angle $\theta w2$ is determined by the angular allowance setting unit 13c by subtracting an appropriate allowance angle $\Delta\theta 3$ from the appropriate picking end crank angle $\theta e$. If the loom provided with the picking period setting device requires the picking control unit 2 to use only the weft yarn release crank angle $\theta w1$ and not to use the weft yarn check crank angle $\theta w2$, the reference picking signal S1O may represent only the weft yarn release crank angle $\theta w1$.

As shown in FIG. 7, the comparator 15 compares the appropriate picking start crank angle $\theta s$ and the appropriate picking end crank angle $\theta e$ determined by the appropriate picking period deciding unit 13 respectively with a reference picking start crank angle $\theta so$ and a reference picking end crank angle $\theta eo$ given to the comparator 15 by a data setting unit. The comparator 15 may provide a loom stop signal St when the either the difference between the appropriate picking start crank angle $\theta s$ and the reference picking start crank angle $\theta so$ or the difference between the appropriate picking end crank angle $\theta e$ and the reference picking end crank angle $\theta eo$ is greater than a predetermined value. The loom stop signal St is applied to a loom controller, not shown, to stop the loom. Thus, the faulty shedding motion of the heddle frames can be surely detected and the loom can be stopped in such an occasion.

The reference picking signal S1O may be applied to the comparator 15 to enable the comparator to detect the deviation of the weft yarn release crank angle $\theta w1$ and the weft yarn check crank angle $\theta w2$ respectively from predetermined ranges.

Figure 8:
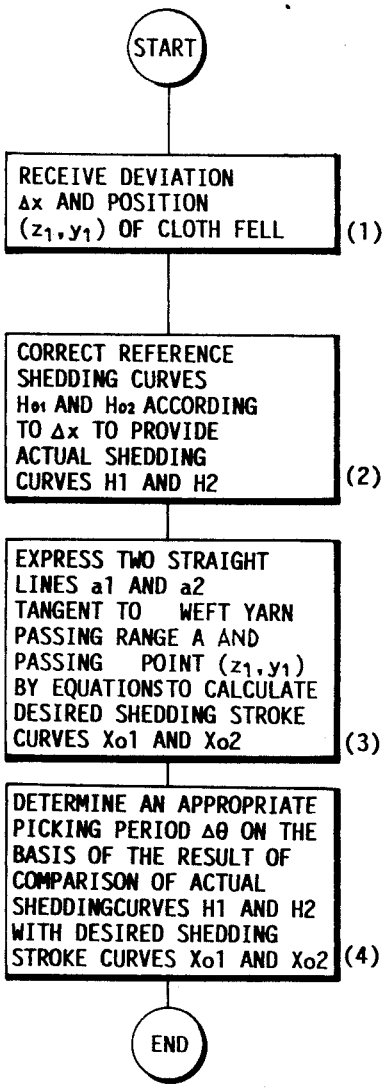
FIGS. 8 and 9 are flow charts of a program to be executed by a picking period setting device in a third embodiment according to the present invention.
Figure 9:
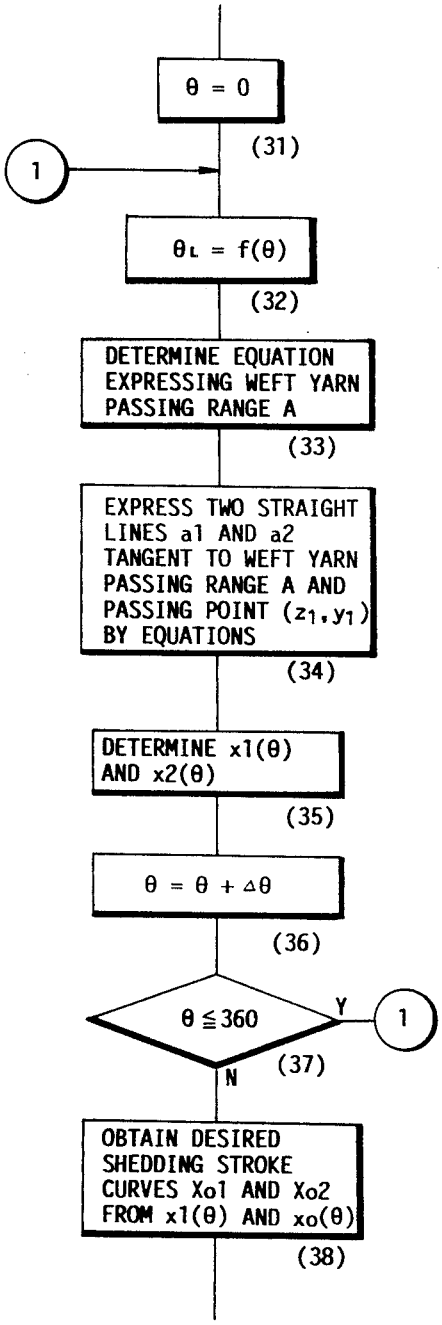

It is possible to carry out the essential functions of the picking period setting device 1 by software including programs as shown in FIGS. 8 and 9 usable on a microcomputer.

In carrying out the functions of the picking period setting device 1 by a microcomputer in accordance with the program shown in FIG. 8, the microcomputer receives detection signals representing the deviation $\Delta x$ of the heddle frame S1 and the position $(z_1, y_1)$ of the cloth fell from the heddle frame sensor 22 and the cloth fell sensor 23 in step 1, and then translates the reference shedding curves Ho1 and Ho2 provided by the data setting unit 21 by the deviation $\Delta x$ to provide the actual shedding curves H1 and H2 in step 2.

In step 3, the desired shedding stroke curves Xo1 and Xo2 are determined by the program shown in FIG. 9. In step 31, the crank angle $\theta$ of the loom is set at zero, and then a beating angle $\theta L$ for $\theta=0$ is calculated in step 32 by using $\theta L=f(\theta)$. The function $f(\theta)$ is stored beforehand i the data setting unit 21.

Subsequently, in step 33, an equation expressing a weft yarn passing range A for the beating angle $\theta L$ is determined, equations expressing two straight lines a1 and a2 tangent to the weft yarn passing range A and passing the position $(z_1, y_1)$ of the cloth fell are determined in step 34, and then the values $x1(\theta)$ and $x2(\theta)$ of distances x1 and x2 for $\theta=0$ are determined from the X-intercepts ax1 and ax2 of the straight lines a1 and a2 in step 35. The distances x1 and x2 correspond to desired shedding strokes when $\theta=0$. In step 36, a small incremental angle $\Delta\theta$ is added to the crank angle $\theta$ ($\theta=\theta+\Delta\theta$). In step 37, query is made to see if $\theta\leqq 360°$. When the response in step 37 is affirmative, steps 32 through 37 are repeated to obtain values $x1(\theta)$ and $x2(\theta)$ of the distances x1 and x2 for the crank angles between 0° and 360°. In step 38, desired shedding stroke curves Xo1 and Xo2 are produced by plotting the calculated values $x1(\theta)$ and $x2(\theta)$ for the crank angles. Then, in step 4, the actual shedding curves H1 and H2 and the desired shedding stroke curves Xo1 and Xo2 are compared to decide an appropriate picking period $\Delta\theta$.

It is apparent from the comparison of the programs shown in FIGS. 8 and 9 and the picking period setting device shown in FIG. 3 that steps 1 and 2 correspond to the function of the shedding curve calculating unit 11, step 3 (steps 31 to 38) corresponds to the function of the desired shedding stroke calculating unit 12, and step 4 corresponds to the function of the appropriate picking period deciding unit 13.

Each of the picking period setting devices 1 embodying the present invention may be an on-line device incorporated into the picking controller of a loom or an off-line device to be connected to the picking controller of a loom only for setting the picking controller. When the picking period setting device 1 is used as an off-line device, the output data of the heddle frame sensor 22 and the cloth fell sensor 23 are fed to the picking period setting device 1 by means of a manual input device, and the output data of the picking period setting device 1 is fed to the picking controller of the loom by means of a manual input device or fed directly to the picking controller through a temporary cable to store the output data of the picking period setting device 1 in the picking controller.

Thus, according to the present invention, the size and position of a weft yarn passing range defined on the reed and the position of the cloth fell are determined, and then two straight lines tangent to the weft yarn passing range and passing the position of the cloth fell are calculated. The upper straight line indicates the lower limit position of the upper warp yarns of the shed, and the lower straight line indicates the upper limit position of the lower warp yarns of the shed to avoid the interference of the warp yarns with a picked weft yarn; that is, the upper warp yarns raised beyond the upper straight line, and the lower warp yarns depressed beyond the lower straight line form a satisfactory shed. Desired shedding strokes of the heddle frames can be determined from the intercepts of the two straight lines on a line included in a plane in which the heddle frames are raised and depressed.

The distance between the weft yarn passing range defined on the reed and the heddle frame varies with the beating angle. Since the beating angle is a function of the crank angle of the loom, the desired shedding strokes can be represented by desired shedding stroke curves obtained through calculation respectively as functions of the crank angle of the loom varying in the range of 0° to 360° in each weaving cycle of the loom.

Since the shedding motion of the heddle frame is a function of the crank angle of the loom and is expressed by a shedding curve, an appropriate picking period in each weaving cycle can be determined by comparing the desired shedding stroke curve and the shedding curve; that is, an appropriate picking period corresponds to a crank angle range in which the upper and lower warp yarns of a shed are moved beyond the desired shedding stroke curves.

When the operating period of the picking device is determined on the basis of the appropriate picking period taking into account the predetermined angular allowance, the picking operation can be satisfactorily achieved regardless of variations in the parameters of the shedding motion of the heddle frames as long as the variation of the picking period due to variations in the parameters of the shedding motion is within the angular allowance.

The detection of the deviation of the heddle frame from the reference position attributable to the elongation of the wires for driving the heddle frame by the heddle frame sensor and the correction of the reference shedding curves according to the detected deviation enables the correction of the appropriate picking period. Furthermore, the appropriate picking period can be corrected according to the variation of the position of the cloth fell on the basis of the variation the position of the cloth fell detected by the cloth fell sensor.

The comparator compares the thus determined appropriate picking period with a predetermined reference picking period and provides a signal to stop the loom when the appropriate picking period conflicts with the predetermined reference picking period. Accordingly, excessive variations in the parameters of the shedding motion can be detected individually instead of inclusively as faulty picking.

Either the heddle frame sensor 22 or the cloth fell sensor 23 or both the heddle frame sensor 22 and the cloth fell sensor 23 may be omitted. When the sensor or the sensors are omitted, the output signals of the sensors are substituted by a predetermined displacement of the heddle frames and/or the coordinates of the cloth fell determined in setting the loom.

As is apparent from the foregoing description, a picking period setting device according to the present invention comprises a shedding curve calculating unit, a desired shedding stroke calculating unit and an appropriate picking period calculating unit, the shedding curve calculating unit calculates shedding curves representing the movement of the heddle frames with the crank angle of the loom, the desired shedding stroke calculating unit calculates desired shedding stroke curves for the heddle frames as a function of a weft yarn passing range, beating angle and the position of the cloth fell, and the appropriate picking period calculating unit determines an appropriate picking period through the comparison of the shedding curves and the desired shedding stroke curves. Accordingly, the appropriate picking period, which has been determined manually by the operator through the visual observation of the relative positions of the relevant components of the loom, can be automatically carried out. The detection of the movement of the heddle frame by the heddle frame sensor enables the precise reflection of the shedding stroke of the heddle frame on the determination of the appropriate picking period, and hence the operating period of the picking device can be precisely controlled according to the variation of the parameters of the shedding motion including the elongation of the wires. Thus, the weaving operation of the loom is continued smoothly without being interrupted by faulty picking and thereby the rate of operation of the loom is improved remarkably.

What is claimed is:

1. A picking period setting device for a loom said loom having shedding curves, heddle frames, a main shaft, said heddle frame having a curved shedding stroke, said loom further having reed beating angles and for producing cloth and having a crank angle, comprising:

shedding curve calculating means for calculating the shedding curves representing the positional variation of the heddle frames of the loom with the crank angle of the main shaft of the loom;

desired shedding stroke calculating means for calculating desired shedding stroke curves representing the variation of the shedding strokes of the heddle frames as a function of a weft yarn passing range defined on the reed, beating angle, the position of the cloth fell and the crank angle of the loom; and appropriate picking period deciding means for deciding an appropriate picking period on the basis of comparison of the shedding curves and the desired shedding stroke curves 2. A picking period setting device for a loom according to claim 1, further comprising data setting means which feeds data representing desired shedding curves to said shedding curve calculating means, and feeds data of the weft yarn passing range, and beating angle to said desired shedding stroke calculating means.

3. A picking period setting device for a loom according to claim 2, wherein said shedding curve calculating means corrects the desired shedding curves on the basis of a deviation of the heddle frame from a reference position detected by a heddle frame sensor to provide the shedding curves.

4. A picking period setting device for a loom according to claims 1 or 3 wherein said desired shedding stroke calculating means uses data indicating the position of the cloth fell detected by a cloth fell sensor in calculating the desired shedding stroke curves.

5. A picking period setting device for a loom according to claim 1, wherein said appropriate picking period deciding means includes comparing means which provides a loom stop signal to stop the loom when the appropriate picking period conflicts with a predetermined reference picking period.

6. A picking period setting device for a loom according to claim 1, wherein said appropriate picking period deciding means comprises an appropriate picking period calculating unit, an angular allowance setting unit and a reference signal generating unit.

7. A picking period setting device for a loom according to claim 1, wherein said shedding curve calculating means, said desired shedding stroke calculating means and said appropriate picking period deciding means are embodied by a microcomputer.

8. A picking period setting device for a loom according to claim 1 wherein said loom further comprises:

a drum type weft yarn measuring and storing device, a holding pin controller for controlling the holding pin of said drum type weft yarn measuring and storing device, a picking nozzle controller for controlling the picking nozzle of the loom, an auxiliary nozzle controller for controlling the auxiliary nozzles and stretching nozzle of the loom, and means connecting the auxiliary nozzle controller to the picking period setting device.

* * * * *